US006047998A

United States Patent [19]

Pollard et al.

[11] Patent Number: 6,047,998

[45] Date of Patent: Apr. 11, 2000

[54] CASSETTE AND CASSETTE RACK LOCKING DEVICE

[75] Inventors: Edward E. Pollard; David B. Frodge, both of Lexington, Ky.

[73] Assignee: Mas-Hamilton Group, Inc., Lexington, Ky.

[21] Appl. No.: 09/017,989

[22] Filed: Feb. 3, 1998

[51] Int. Cl.[7] ..... E05C 19/00

[52] U.S. Cl. ..... 292/1; 70/80; 312/216; 109/57; 292/259 R

[58] Field of Search ..... 70/78–80, 85, 70/86, 178, 159–162; 109/53, 56, 57, 47; 312/216, 217, 219, 220, 215; 292/338, 259 R, 339, 1, 2

[56] References Cited

U.S. PATENT DOCUMENTS

| | | | |
|---|---|---|---|
| 259,415 | 6/1882 | Morse et al. . | |
| 490,099 | 1/1893 | Bower . | |
| 618,846 | 2/1899 | Crowder . | |
| 630,505 | 8/1899 | Hicks . | |
| 1,004,758 | 10/1911 | Ebbert . | |
| 1,023,297 | 4/1912 | Chambers . | |
| 1,050,487 | 1/1913 | Pape . | |
| 1,060,018 | 4/1913 | Pape . | |
| 1,075,652 | 10/1913 | Kleber . | |
| 1,189,902 | 7/1916 | Armstrong . | |
| 1,218,821 | 3/1917 | Williams . | |
| 1,259,345 | 3/1918 | Beecham . | |
| 1,330,672 | 2/1920 | Yonge . | |
| 1,343,851 | 6/1920 | Roe . | |
| 1,375,249 | 4/1921 | Grube . | |
| 1,413,658 | 4/1922 | Hawley . | |
| 1,440,146 | 12/1922 | Hawly . | |
| 1,452,471 | 4/1923 | Kline . | |
| 1,455,198 | 5/1923 | Gibson . | |
| 1,462,278 | 7/1923 | Greene . | |
| 1,486,094 | 3/1924 | Lehman . | |
| 1,695,896 | 12/1928 | Holden . | |
| 1,723,125 | 8/1929 | Best . | |
| 1,738,004 | 12/1929 | Holden . | |
| 1,817,191 | 8/1931 | Harmony . | |
| 2,130,617 | 9/1938 | Dockham | 312/189 |
| 2,410,255 | 10/1946 | Wells | 40/102 |
| 2,452,512 | 10/1948 | Wells | 45/94 |
| 2,716,882 | 9/1955 | Gill et al. | 70/159 |

(List continued on next page.)

*Primary Examiner*—Teri Pham
*Attorney, Agent, or Firm*—Rustan J. Hill; Laurence R. Letson

[57] ABSTRACT

A locking device is disclosed which substantially restricts access to the cassettes or drawers within a vault or safe, including an ATM or ABM, and also restricts access to the cassette rack of the ATM/ABM, both resident within the vault or safe of an ATM/ABM. The blocking member restricts access to the cassettes or drawers and the cassette rack is mounted on a pair of supporting pins on a mounting bracket attached to the interior of a vault or safe, including an ATM/ABM. The blocking member may be removed from the supporting pins only after unlocking and withdrawal of a lock bolt from a strike hole in the mounting bracket. The blocking member must be lifted off the support pins and laid aside and later re-installed. By extending the bolt into the strike hole of the mounting bracket, the only available degree of freedom is eliminated preventing removal of the blocking member from the mounting bracket. Pivoting of the blocking member about the supporting pins is restricted by pivot blocks and/or a selection of cross sectional shapes of the pins and the mating holes in the blocking member. Locks of various natures may be used to control the removal of the blocking member. A requisite lock would have an extendible bolt which may extend into and through the strike hole in the mounting bracket.

15 Claims, 4 Drawing Sheets

U.S. PATENT DOCUMENTS

| | | | |
|---|---|---|---|
| 2,913,296 | 11/1959 | Martin | 312/216 |
| 2,967,080 | 1/1961 | Nelson | 312/216 |
| 3,002,800 | 10/1961 | McMahan | 312/216 |
| 3,189,392 | 6/1965 | Mehlig, Jr. et al. | 70/85 |
| 3,806,179 | 4/1974 | Roessle | 292/259 R |
| 3,821,884 | 7/1974 | Walsh | 292/259 R |
| 3,856,373 | 12/1974 | Tucich | 70/85 |
| 3,888,096 | 6/1975 | Huss | 70/209 |
| 3,893,740 | 7/1975 | England | 312/216 |
| 3,945,227 | 3/1976 | Reiland | 70/58 |
| 3,971,240 | 7/1976 | Love, Sr. | 70/160 |
| 4,131,173 | 12/1978 | Boersma | 70/160 |
| 4,161,274 | 7/1979 | Bishop et al. | 232/24 |
| 4,209,211 | 6/1980 | Alford | 312/215 |
| 4,350,032 | 9/1982 | Kochackis | 70/427 |
| 4,418,551 | 12/1983 | Kochackis | 70/18 |
| 4,465,329 | 8/1984 | Haas et al. | 292/259 R |
| 4,598,964 | 7/1986 | Frink et al. | 312/216 |
| 4,845,966 | 7/1989 | Perry | 70/159 |
| 4,998,425 | 3/1991 | Hoogland | 70/159 |
| 5,103,659 | 4/1992 | Benefield, Sr. | 312/216 |
| 5,165,262 | 11/1992 | Brem et al. | 70/158 |
| 5,205,628 | 4/1993 | Swets et al. | 312/216 |
| 5,314,244 | 5/1994 | Swets et al. | 312/330.1 |
| 5,826,853 | 10/1998 | Anello et al. | 70/161 |

CASSETTE AND CASSETTE RACK LOCKING DEVICE

FIELD OF THE INVENTION

This invention relates to the field of automated teller machines and more specifically to the securing at all times of cash or negotiable instrument cassettes within a cassette rack of an automated teller machine and, particularly, whenever the automated teller machine vault is open.

BACKGROUND OF THE INVENTION

Automated Teller Machines, ATMs as they are commonly referred to or ABMs (for Automated Banking Machines in Canada), are devices which dispense currency to holders of valid bank cards and other identifying information among other functions. For ease, both ATMs and ABMs will be referred to as ATMs. The machines may also be used to dispense other negotiable instruments such as scrip, coupons, tickets and other items which are reprinted or may be printed to create high value negotiable instruments. The currency storage (used to describe storage of any negotiable instrument) within the ATM vault is accomplished in currency cassettes or cash cassettes typically holding up to 2,000 bills each. The cassettes are inserted into a rack which further includes a sheet feed and transport mechanism for picking and transporting the bills from the currency cassettes to a dispensing opening in the ATM structure.

The cassette rack is typically mounted in such a manner that it may be pulled out of the vault to access the various portions of the currency rack and bill picking and transport mechanism in order to permit the maintenance and repair of the device as well as to clear bill feed jams which may occur in the bill feeding and transporting mechanism.

Once the ATM vault, which is simply a secure safe or similar container, is opened, the cassettes and the cassette rack are accessible even when the purpose for opening the vault is unrelated to accessing the cassettes. Due to the security afforded by the vault, most of the losses from ATM's are due to insider theft. Authorized opening of the vault grants access to large sums of cash or other instruments and presents an opportunity to the person opening the vault to commit an unobserved act of dishonesty and steal some or all of the contents of the cassettes.

One approach to securing the cassettes within the cassette rack is the CashBar device available from Safepak Corporation, Portland, Oreg. The CashBar device is a large sturdy hasp mounted on one side plate of the cassette rack and engaging and covering a strike mounted on the opposite side plate of the cassette rack. The hasp carries a lock which accomplishes latching by extending a bolt through an aperture in the strike plate. The hasp is hinged near the attachment location. The hasp carries a vertically oriented bar or bar-like member extending across the face of at least one cassette which does not lie behind the hasp.

This CashBar device addresses the removal of the cassettes from the cassette rack; however, the CashBar device does not address preventing the rolling of the cassette rack out of the vault to provide for service. If the cassette rack is pulled or rolled out of the ATM vault to the limit of its travel, small quantities of currency may possibly be picked and partially fed from the bill feed mechanism and removed by an individual. Thus, there remains a security risk, reduced but still substantial.

The use of some device which secures the cassettes in the cassette rack so that currency cannot be removed is highly desirable so that there may be bifurcated or dual access to the vault but at the same time restrict access to the currency to only the organization responsible for the money while granting vault access to another organization to permit maintenance and service work without the service personnel having access to the stored currency supply.

OBJECTS OF THE INVENTION

It is an object of the invention to securely restrict access to the stored negotiable instruments or currency in an ATM vault.

It is another object of the invention to prevent withdrawal of the cassettes from the cassette rack of an ATM.

It is an additional object of the invention to prevent withdrawal of the cassette rack from the vault of the ATM.

It is a still further object of the invention to increase security of the negotiable instruments or currency within the vault of the ATM.

It is still another object of the invention to prevent access to the contents of the cassettes within the cassette rack of an ATM machine.

It is still an additional object of the invention to prevent access to the bill feed and transport mechanism of the ATM currency rack.

SUMMARY OF THE INVENTION

A currency cassette and cassette rack locking device prevents cassette or cassette rack removal or rollout from the ATM vault. The cassette locking device is mounted to a side interior wall of an ATM vault near the vault door by bolts, screws or welding. The wall mounting bracket has a pair of pins both extending in the same direction, preferably upwardly. The bracket defines an opening or hole in the portion of the bracket that is aligned to accept an extended lock bolt. The locking bracket of the security device is a rigid door-like member carrying thereon a lock with an extendible bolt.

The door-like member is incapable of and prevented from pivoting on the pins of the mounting bracket due either to the mating of the pins and the door-like member or the configuration of the door-like member which may engage the structure of the vault.

The door-like member may be removed from the pins and laid aside and thereafter reinstalled to provide the locking function with respect to the cassettes and the cassette rack of the ATM. Removal is accomplished by sliding the mating portion of the blocking door-like member off the pins.

Removal may only be accomplished whenever the bolt of the associated lock is withdrawn from the strike hole in the mounting bracket. To prevent removal of the locking member, the lock bolt may be extended into the strike hole in the mounting bracket. The extended bolt protruding through the strike hole prevents relative movement of the locking and mounting brackets with respect to each other in the one degree of freedom which remains and permits removal and installation of the locking bracket.

Once the locking bracket is installed and locked, the cassette rack as well as the cassettes may not be extended or removed from the ATM vault, thereby providing a substantial increase in the degree of security for the cassettes and the currency contained or stored therein.

The locking member may be outfitted with a mechanical bolt lock, a mechanical combination lock, an electronic combination lock, or an electronic bolt lock as desired.

Similarly, where the invention is described with respect to cash or currency cassettes, it would be equally applicable to a device which dispenses items such as money orders, coupons, food stamp coupons or other devices that contain cash, checks or currency which may have been deposited and documents that may be of significant monetary value. The term cassette should be understood to include containers, drawers, hoppers or other devices that either dispense or receive such items.

The foregoing section provides only a summary and a more detailed understanding of the invention may be secured from the attached drawings and the detailed description of the preferred embodiment of the best mode of the invention to follow.

DRAWINGS

DETAILED DESCRIPTION OF THE PREFERRED EMBODIMENT OF THE

BEST MODE OF THE INVENTION AS CONTEMPLATED BY THE INVENTORS

Figure 1:
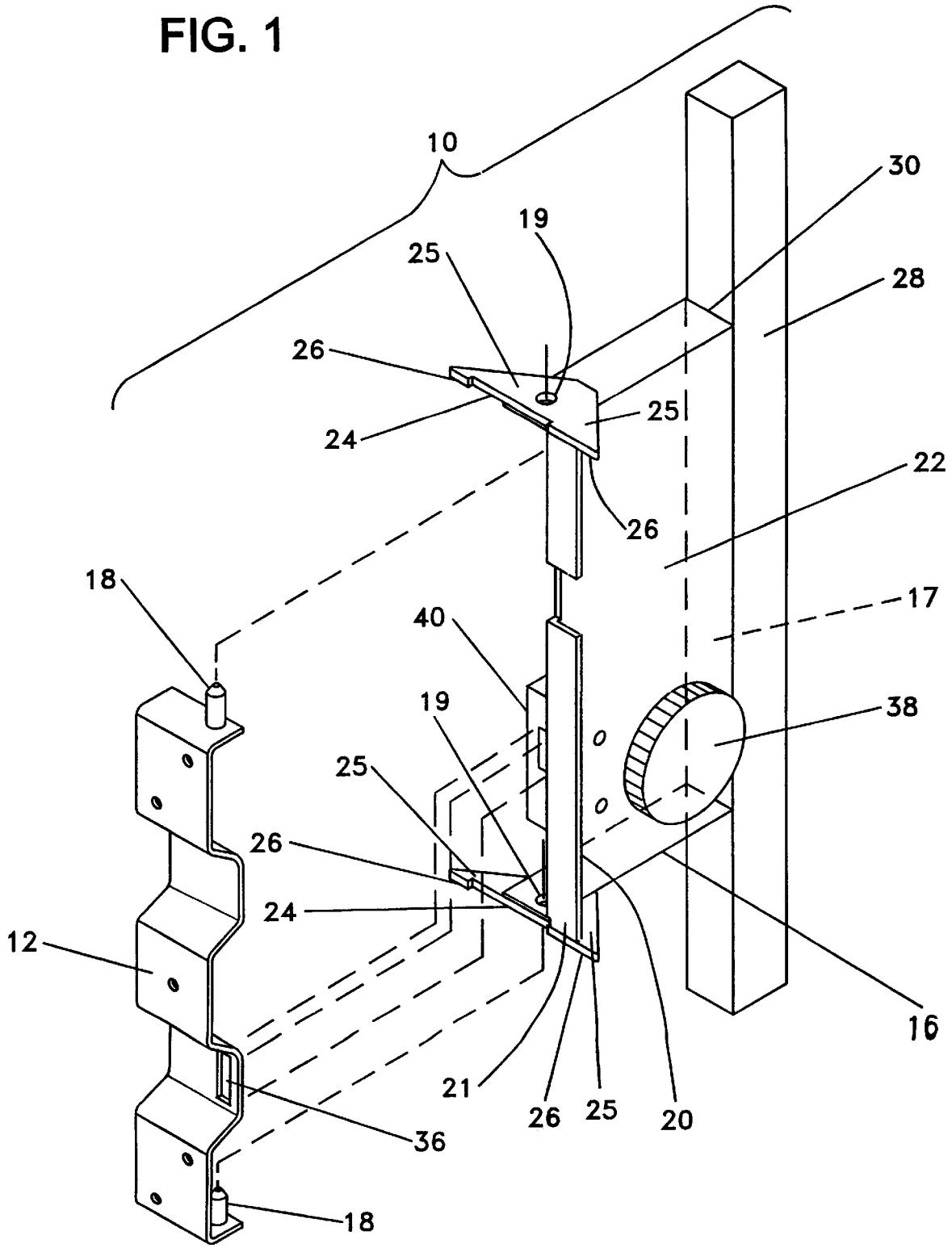
FIG. 1 is a partially exploded perspective view of the cassette locking device.
Figure 2:
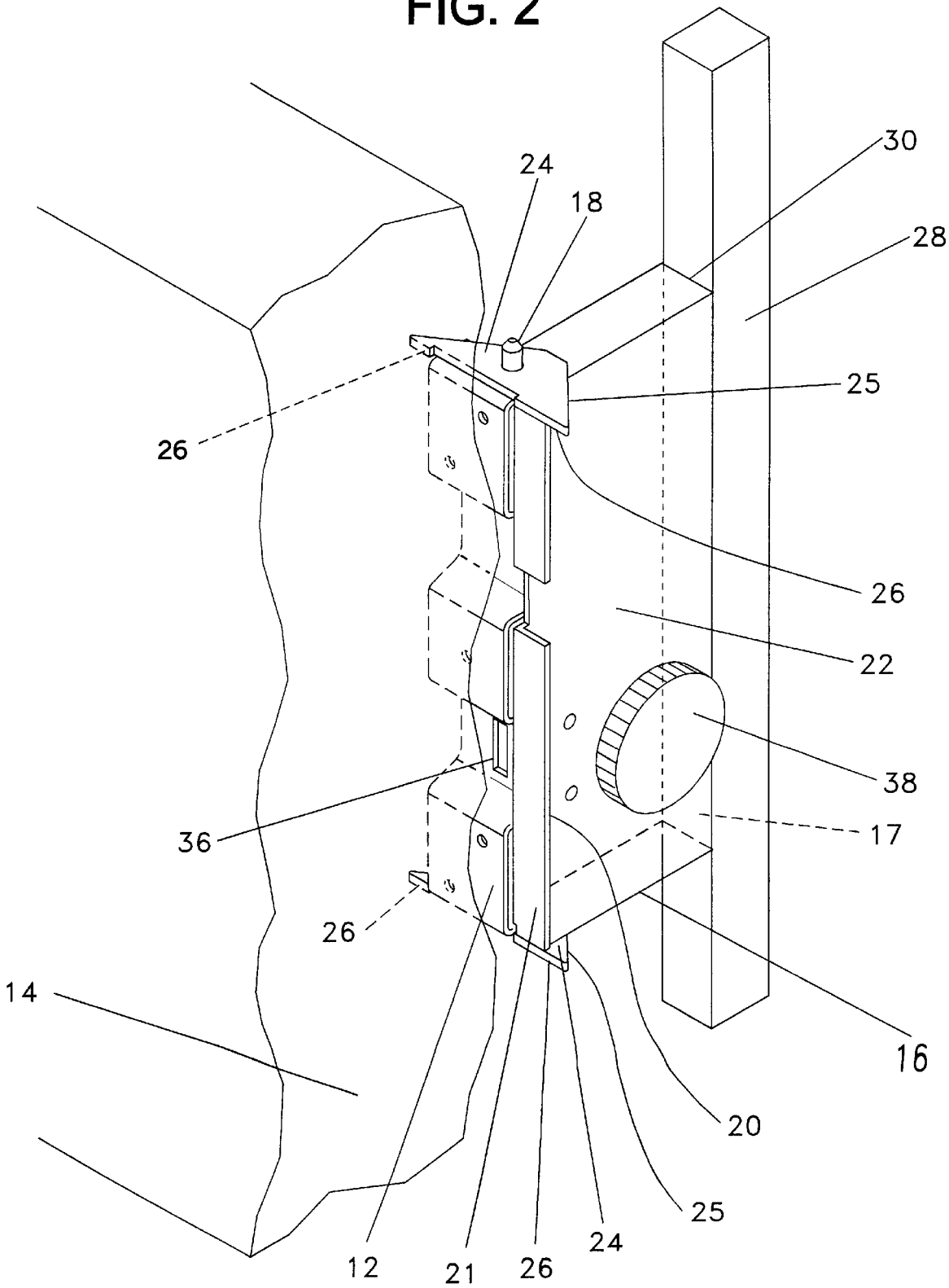
FIG. 2 is a perspective view of the cassette locking device together with a partial wall of an ATM vault.

Referring the various figures of the drawings, the cassette locking device 10 is illustrated. The device 10 is made up of a mounting bracket 12 and a cassette blocking member 16. The mounting bracket 12 serves several functions including mounting the cassette locking device 10 to the wall of an ATM or ABM (referred to hereinafter as ATM) vault 14. Additionally, the mounting bracket 12 supports the cassette blocking member 16. Cassette blocking member 16 is preferably formed of a heavy gauge sheet metal sufficient in rigidity to be resistant to bending or deformation by hand or hand tool forces.

The cassette blocking member 16 preferably is formed in the shape of a partial shallow box which lends itself to containing or at least partially enclosing a lock mechanism 40 mounted therein. The cassette blocking member 16, in the form of a partial box, should have at least four sides to shield the lock mechanism 40 from access and provide sufficient rigidity to resist bending and deformation of blocking member 16.

Mounting bracket 12 is provided with two upstanding pins 18 preferably on a common or aligned axis. The mating members or pins 18 provide location and support for the cassette blocking member 16, which is disposable thereon. If desired, the pins 18 could be disposed on the cassette blocking device 16 and the pins 18 positioned to mate with the mounting bracket 12.

Cassette blocking member 16 is formed with the edge 20 or side closest to the vault 14 and mounting bracket 12 to be formed up as a flange 21 in a direction to extend parallel to the wall of vault 14 and forward toward the door opening of vault 14. The flange 21 further adds rigidity to the blocking member 16 and restricts access to the lock 40/mounting bracket 12 interface. This permits insertion of the mounting bracket 12 into the partial cavity 17 of the cassette blocking member 16. The cassette blocking member 16 also has a pair of holes 19 formed in opposing walls of the cassette blocking member 16 and aligned to fit over the pins 18 of the mounting bracket 12. The formed up edge 20 of the front plate 22 of cassette blocking member 16 preferably extends substantially parallel to the wall of the ATM vault 14. With cassette blocking member 16 installed on the pins 18, the formed up edge 20 of the cassette blocking member 16 will not pivot past or clear the mounting bracket 12 as the cassette blocking member 16 is attempted to be moved in a pivoting movement about the axis of pins 18. A portion of front plate 22 of cassette blocking member 16 will interfere with the mounting bracket 12, thereby resisting pivotal movement of the cassette blocking member 16 about pins 18.

To enhance the resistance to pivoting movement of the cassette blocking member 16 around pins 18, pivot blocks 24 rigidly attach to the cassette blocking member 16 and form extending arm portions 25 that project generally in a plane perpendicular to the axis of the pins 18. The pivot blocks 24 have surfaces 26 juxtaposed with the interior face of vault 14 to engage therewith and resist any attempted pivoting movement of cassette blocking member 16 about pins 18.

If desired, pins 18 could be made in a square or other non-circular cross-section and the mating holes 19 be similarly shaped to further resist any pivoting motion of the cassette blocking member 16 with respect to the mounting bracket 12. In the preferred embodiment of the invention, the pivot blocks 24 are welded or otherwise rigidly attached to the cassette blocking member 16.

Figure 3:
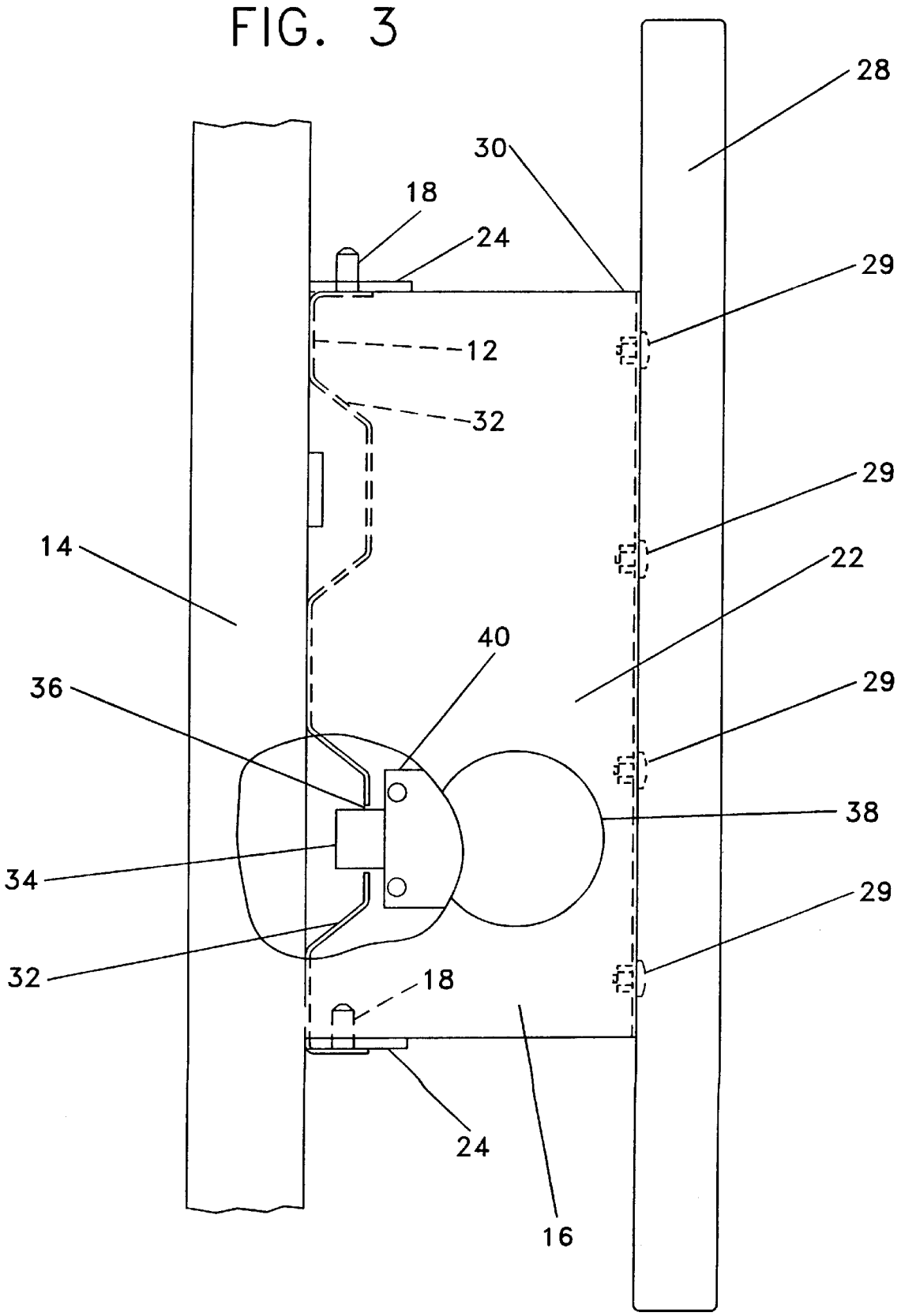
FIG. 3 is a front elevation view of the cassette locking device mounted on a segment of an ATM vault.
Figure 4:
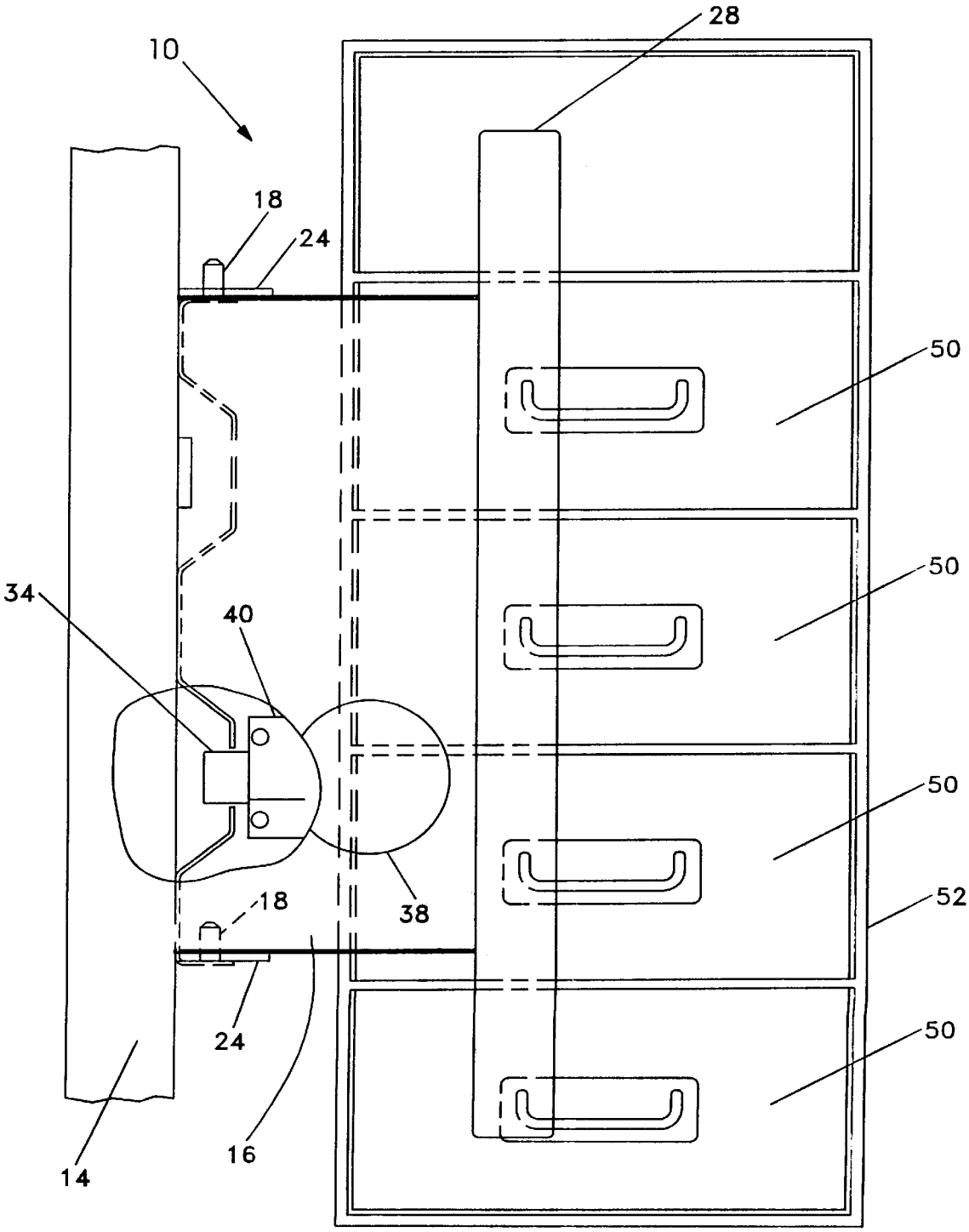
FIG. 4 illustrates the cassette locking device mounted on a vault wall in blocking relation to currency cassette and cassette rack of an ATM.

The cassette blocking member 16 need be fabricated only large enough to provide a substantial resistance to the pivoting about the pins 18 and rigid enough to substantially resist bending and accept a lock 40 therein, thereby reducing the weight of the blocking member 16, making blocking member 16 easier to remove and reinstall. However, due to the ATM's being designed to accommodate from two to four cassettes 50 as seen in FIG. 4, the cassette blocking member 16 may not be large enough to block all cassettes and/or any other portion of the cassette rack 52 which is openable or removable. Accordingly, an additional blocking member 28 may be installed onto the outboard edge 30 of cassette blocking member 16 extending the blocking span of the cassette locking device 10 to encompass the requisite number of cassettes 50. The additional blocking member 28 may be in the form of an elongated member or bar, preferably in a hollow form or formed as an open-sided box. With an open-sided box form, the elongated blocking bar 28 lends itself to attachment to the cassette blocking member 16 with bolt nuts assemblies 29. FIG. 3, while denying access to the bolts 29 for removal once the bar 28 is attached to and installed and locked.

The mounting bracket 12 is formed with a projecting portions 32 extending toward the lock 40. The projecting portion 32 provides clearance therebehind to allow lock 40 to fully extend bolt 34. Bolt 34 is extended through a strike hole 36 in the projecting portion of the mounting bracket 12. The lock 40 may be operated by the lock dial 38 to control bolt extension and withdrawal as well as operation of any internal locking mechanism controlling the bolt 34. Various offset drives may be used to convey the operational movement from dial 38 to lock 40, permitting the non-axial mounting of the dial further permitting installation in shallow spaces.

Due to the complementary action of bolt 34 and strike hole 36 when the lock bolt 34 is extended, the cassette blocking member 16 may not be removed from the pins 18; the pivot blocks 24 and the bolt 34 in the strike hole 36 prevent pivotal movement of the cassette blocking member 16, thereby providing a very substantial physical impediment to removal of a cassette 50 or its contents from the ATM vault 14. It is understood the term cassette includes drawers, containers or the like that may contain negotiable instruments or cash.

Accordingly, with bolt 34 extended into strike hole 36, the cassette blocking member 16 and blocking bar 28 deny access to the contents of the currency cassettes 50 in the cassette rack 52 of the ATM. The mounting bracket 12 may be fabricated with pins 18 extending in a direction opposite to that illustrated in FIGS. 1–4 and the bracket 12 inverted to provide opposite side installation. The cassette blocking member 16 and blocking bar 28 may be installed on the inverted mounting bracket 12 by inverting blocking member 16 with equal efficacy.

Inasmuch as the cassette blocking member 16/blocking bar 28 prevent the withdrawal of the cassettes, by interference, the cassette rack 52 is similarly barred from movement effectively preventing access to the contents of the currency cassettes 50.

To gain access to the cassettes 50 or the cassette rack 52 the lock 40 is unlocked and the bolt 34 withdrawn from strike hole 36. The cassette blocking member 16 and blocking bar 28 are removed from pins 18 and laid aside. After accessing the cassette 50 or cassette rack 52, the cassette blocking member 16 is re-installed on pins 18 and the lock bolt 34 extended through the strike hole 36. Thus, access to the cassettes 50 and the cassette rack 52 may be restricted to personnel of the organization responsible for the currency in the ATM, such as an armored car company or armored car servicing company without giving access to an organization whose responsibility only is to maintain the other portions of the ATM, such as the electronic controls.

As described above, the extension of the bolt 34 into strike hole 36 eliminates or effectively restricts the only degree of freedom of movement of the cassette blocking member 16, that being parallel to the longitudinal axis of the pins 18.

It should be understood that one skilled in the art may make various changes in the design such as suggested herein as well as others, without departing from the scope of protection afforded by the attached claims.

We claim:

1. A security device for securing negotiable instrument cassettes within a dispensing machine which dispenses negotiable instruments, said device comprising:

a mounting bracket, said bracket mountable on a surface within a vault of said dispensing machine, said mounting bracket comprising at least one mating member;

a blocking member for removable disposition on said at least one mating member;

at least one pivot block rigidly attached to said blocking member and engageable with said surface to prevent pivoting of said blocking member relative to said mounting bracket while said blocking member is disposed on said at least one mating member;

said mounting bracket further defining a hole therein of a size, shape and orientation to accept a bolt of a lock; and said blocking member supporting thereon said lock having said bolt, said lock disposed on said blocking member to mate said bolt with said hole in said mounting bracket when extended, thereby preventing the removal of said blocking member from said mounting bracket and preventing removal of cassettes from said dispensing machine by displacing said cassettes through a plane of and within boundaries of said blocking member when said blocking member is disposed on said at least one mating member.

2. The security device of claim 1 wherein said mounting bracket comprises a pair of said mating members and said blocking member comprises a pair of mating members, whereby said mating members of said mounting bracket mate with said mating members of said blocking bracket.

3. The security device of claim 2 wherein said pivot block comprises a rigid member extending from said blocking member in at least a direction preventing pivoting of said blocking member in a direction to permit access to and removal of said cassettes from said dispensing machine.

4. The security device of claim 2 wherein said blocking member, when mated with said mounting bracket, possesses a single degree of freedom of movement.

5. The security device of claim 4 wherein said single degree of freedom of movement is defeated by extension of said lock bolt into said hole.

6. The security device of claim 2 wherein said pair of mating members of one of said blocking member and said mounting bracket comprise a pair of pins extending therefrom and said mating members of said other of said blocking member and said mounting bracket comprise a pair of holes dimensioned to accommodate said pins.

7. The security device of claim 2 wherein said pivot block comprises a rigid member extending in at least a direction forward from said blocking member, away from said mounting bracket and installable with at least one surface adjacent said interior wall surfaces of said vault.

8. The security device of claim 7 wherein said security device comprises at least two of said pivot blocks.

9. The security device of claim 8 wherein said pivot blocks are disposed on said blocking member at a point surrounding said mating members.

10. The security device of claim 1 wherein said blocking member rigidly supports a bar like member adapted to extend juxtaposed with a plurality of said cassettes, thereby blocking a larger plurality of cassettes than possible with only said blocking member.

11. The security device of claim 10 wherein said bar like member is disposed on and attached to said blocking member at an edge of said blocking member installable proximate said cassettes.

12. The security device of claim 10 wherein said bar like member is installable to extend across a plurality of said cassettes.

13. A security device for blocking assess to and the removal of currency cassettes and withdrawal of a currency cassette rack from an ATM vault comprising:

a mounting bracket attachable to an interior wall surface of said ATM vault;

a blocking member disposed on and removable from said mounting bracket and projecting therefrom to a position for blocking the withdrawal of both said currency cassette and said cassette rack from said ATM vault, said blocking member incapable of movement except in a single degree of freedom relative to said mounting bracket, while said blocking member is disposed on said mounting bracket;

a lock and lock bolt, said lock and lock bolt carried by said blocking member and operable to extend said lock bolt through an aligned hole in said mounting bracket to prevent movement of said blocking member relative to said bracket.

14. The security device of claim 13 wherein said blocking member comprises surfaces thereon which are positionable juxtaposed with said vault interior wall surface and engageable with said wall surface if said blocking member is pivoted about said mating members, whereby pivoting said blocking member is restricted, thereby preventing the unauthorized access to said cassettes and said cassette rack.

15. An automated teller machine having a security device for securing currency cassettes, said machine comprising:

a mounting bracket, said bracket mounted on a surface of and within a vault of said automated teller machine, said mounting bracket comprising at least one mating member;

a blocking member disposed on said at least one mating member and further disposed juxtaposed with at least said cassettes;

said mounting bracket further defining a hole therein of a size, shape and orientation to accept a bolt of a lock and further defining a region incorporating said hole displaced from said surface of said vault, thereby disposing said hole in a position to resist pivoting movement of said blocking member relative to said mounting bracket; and said blocking member supporting thereon said lock having said bolt, said lock disposed on said blocking member to mate said bolt with said hole in said mounting bracket when extended, thereby preventing the displacement of said blocking member from a blocking position relative to said cassettes and preventing removal of currency cassettes from said automated teller machine by displacing said cassettes through a plane of and within boundaries of said blocking member when said blocking member is disposed on said at least one mating member and said lock bolt extended through said hole.

* * * * *